US005868946A

United States Patent [19]

Nguyen

[11] Patent Number: 5,868,946

[45] Date of Patent: Feb. 9, 1999

[54] GASOLINE CONTAINER

[76] Inventor: Viet Nguyen, One Main Dr., Lake Intervale, Boonton, N.J. 07005

[21] Appl. No.: 897,748

[22] Filed: Jul. 21, 1997

Related U.S. Application Data

[63] Continuation of Ser. No. 541,159, Oct. 11, 1995, abandoned.

[51] Int. Cl.[6] ..... B01D 21/02; B01D 21/24; B65D 1/24

[52] U.S. Cl. ..... 210/800; 137/546; 210/514; 210/518; 210/464; 210/532.1; 210/539; 210/540; 220/501; 220/554; 222/129

[58] Field of Search ..... 210/513, 800, 210/801, 532.1, 514, 518, 464, 539, 540; 220/562, 563, 564, 500, 501, 502, 553, 554; 222/475.1, 129; 137/546

[56] References Cited

U.S. PATENT DOCUMENTS

| | | | |
|---|---|---|---|
| 285,731 | 9/1883 | Brown | 220/367.1 X |
| 352,195 | 11/1886 | Krag | 220/502 X |
| 1,220,422 | 3/1917 | Hewitt | 220/509 X |
| 1,235,438 | 7/1917 | Chynoweth | 220/DIG. 6 X |
| 1,722,396 | 7/1929 | Reiber | 215/902 X |
| 2,373,118 | 4/1945 | Johnson | 220/367.1 X |
| 3,038,841 | 6/1962 | Swartwout | 220/4.12 X |
| 4,084,937 | 4/1978 | Beach | 220/501 X |
| 4,588,563 | 5/1986 | Fiocco | 210/532.1 X |
| 4,714,168 | 12/1987 | Johnson et al. | 220/502 |
| 4,994,186 | 2/1991 | Hays | 210/464 |
| 4,995,979 | 2/1991 | Versteegh | 210/532.1 X |

FOREIGN PATENT DOCUMENTS

| | | | |
|---|---|---|---|
| 3690 | 2/1884 | United Kingdom | 215/6 |
| 21343 | 10/1902 | United Kingdom | 210/532 |
| 407854 | 3/1934 | United Kingdom | 220/501 |

*Primary Examiner*—Allan N. Shoap
*Assistant Examiner*—Niki M. Kopsidas
*Attorney, Agent, or Firm*—Ernest D. Buff

[57] ABSTRACT

Water and solid debris are separated from gasoline during its storage within a container. The separation is effected automatically, at low cost and in a highly reliable manner. It is continuous throughout storage and is not reversed by portage of the container or removal of gasoline therefrom. Engines fueled with gasoline from the container are far less subject to contamination from water or impurities than those fueled from gas cans of the conventional type.

3 Claims, 3 Drawing Sheets

GASOLINE CONTAINER

This application is a continuation of application Ser. No. 08/541,159, Filed Oct. 11, 1995, now abandoned.

BACKGROUND OF THE INVENTION

1. Field of the Invention

The present invention relates to a container for holding gasoline that is provided with a means for separating dirt and water from stored gasoline.

2. Description of the Prior Art

Portable gasoline storage devices of the type disclosed by Canadian Patent 87,712, and U.S. Pat. No. 4,491,251 typically include a plastic or metal container having a handle, pouring spout, and air relief vent. In some of these containers, a screen is placed in the pouring spout to filter dirt and thereby prevent it and other solid particles from exiting the device.

Methods and means for separation of impurities from liquids such as gasoline are complex and costly, with the result that their use is restricted to very large tanks or industrial processes. Soviet Patent 1,587,003 to Tranov, et al. describes a separator in which water and petroleum are pumped over a plate with a rim. U.S. Pat. No. 5,151,185 to Hammerschmitt et al. describes a multi-chamber device with sloping pipes and vertical pipes. These separation devices are large, complex and costly, and would not be amenable to separation of impurities from liquids in small, portable containers.

Water contamination can seriously effect the performance and mechanical integrity of a gasoline powered engine. Yet, many of these engines, including land vehicle engines, lawn mower engines, chain saw engines, and the like, are frequently refueled using portable gasoline storage devices. In such cases, contamination from water and impurities can damage the engine or impair its performance.

There exists a need in the art for a method and means for separating both water and dirt from gasoline in a portable storage device.

SUMMARY OF THE INVENTION

The present invention provides a portable gasoline container with means for automatically separating water and dirt from gasoline stored therein. Fuel exiting the container is substantially devoid of water and impurities, and contamination of engines fueled therefrom is virtually eliminated.

Generally stated, the container has a spout and a separation means comprising a plate having an opening at one end. The separation means is tightly joined around its edge within the container and forms therewithin a plane that makes a non-zero angle with the container floor. The opening of the plate is positioned at the lower end of the separation means and opposite to the spout. With this construction, the container is divided by the separation means into an upper section and a lower section. Dense materials, such as water and solid debris fall by gravity through the opening into the lower section and become separated from the gasoline automatically. Preferably, the gasoline container further comprises a handle, and a vent.

In addition, the invention provides a process for separating contaminates, such as water and solid debris, from gasoline, comprising the steps of: (1) placing contaminated gasoline into a container having an upper section and a lower section, said upper and lower sections being separated by a plate having an opening in one end and forming within said container a plane that makes a non-zero angle with the container floor; (2) allowing the water and solid debris to be pulled by gravity from said gasoline onto the upper surface of said plate and through said hole to said lower section; and (3) removing gasoline from the container, by pouring it from the upper section.

This invention represents a significant advantage over the prior art in that it provides for a method and device for automatically, simply, and inexpensively separating water and solid debris from gasoline in a portable gasoline storage can.

The method and means of the present invention provide significant advantages over previous gasoline storage devices. Separation of water and solid debris from gasoline is effected automatically, at low cost and in a highly reliable manner. The separation process is continuous throughout storage and is not reversed by portage of the container or removal of gasoline therefrom. Engines fueled with gasoline from the container of the present invention are far less subject to contamination from water or impurities than those fueled from gas cans of the conventional type.

BRIEF DESCRIPTION OF THE DRAWINGS

The invention will be more fully understood and further advantages will become apparent when reference is made to the following detailed description of the preferred embodiment of the invention and the accompanying drawings, in which.

DESCRIPTION OF PREFERRED EMBODIMENTS

Figure 1:
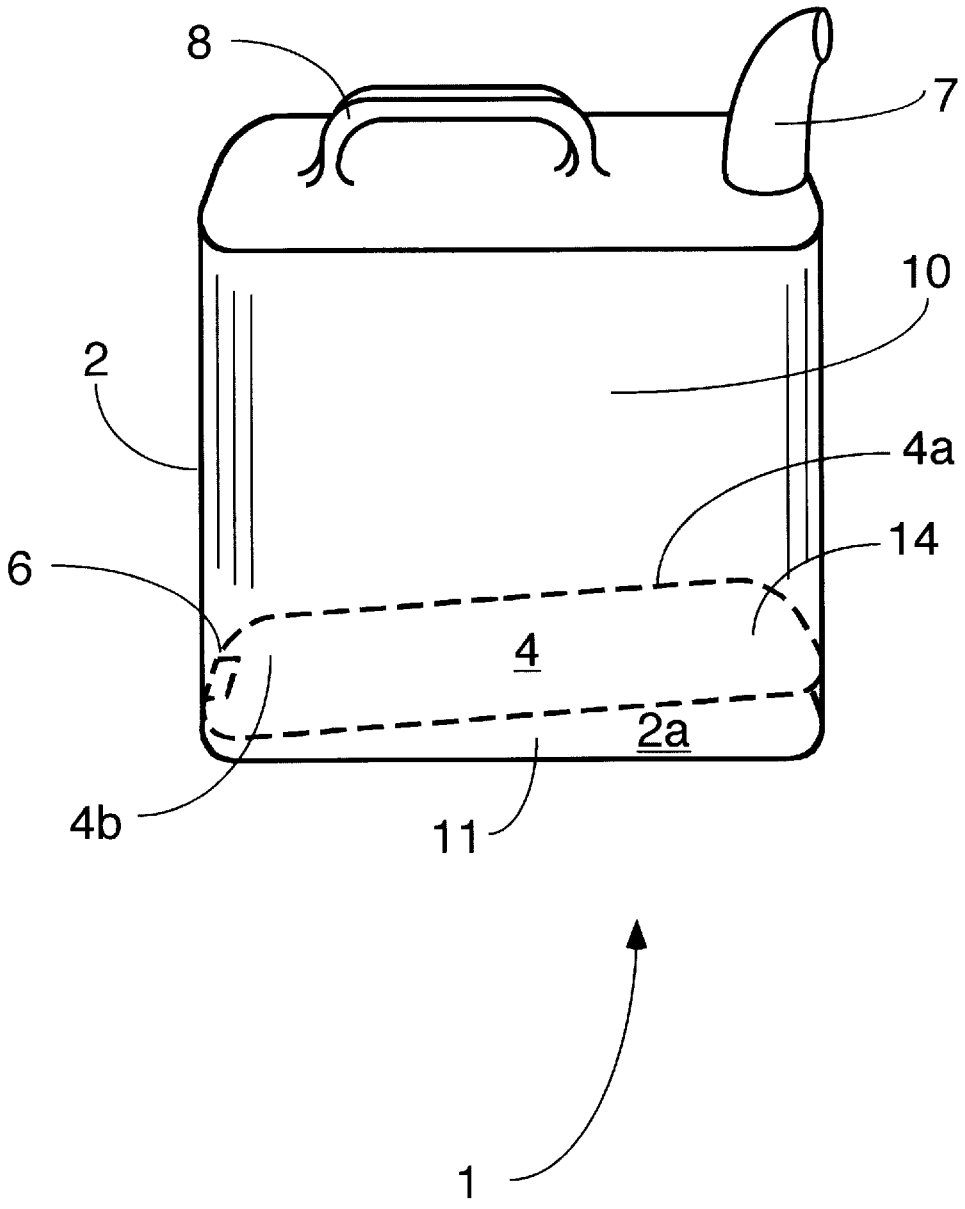
FIG. 1 is an external perspective view of the gasoline container of the present invention showing the arrangement of the separation means therewithin.
Figure 2:
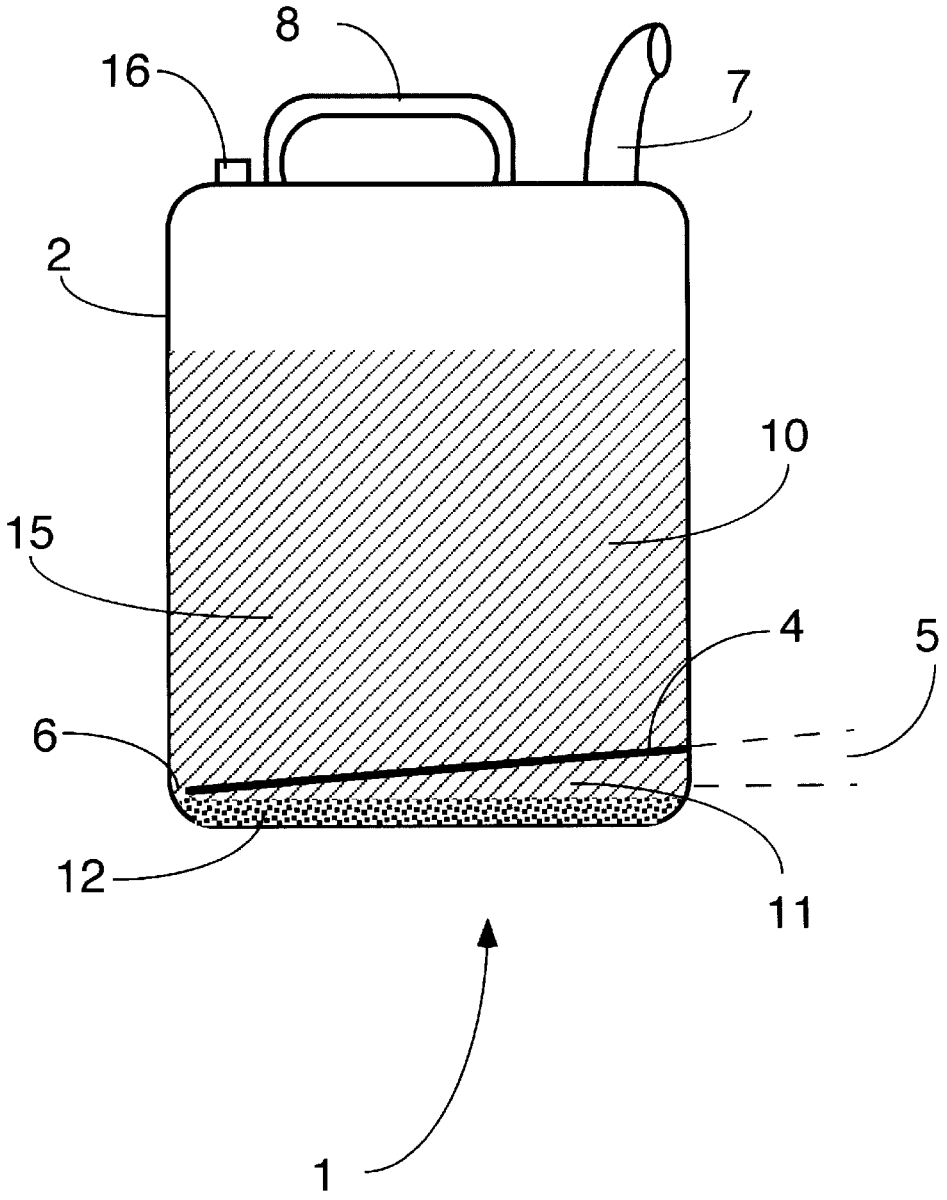
FIG. 2 is a side view of the gasoline container of FIG. 1 having water and dirt separated from the gasoline.

Referring to the drawings, there is shown generally at 1, a gasoline storage device including a container 2 having a ceiling, side walls and floor, a separation means 4 dividing the container 2 into an upper section 10 and a lower section 11, and a spout 7 providing a fuel removing passage in communication with the upper section. Spout 7 is provided with a vent 16 for relief of pressure generated within section 10 by volatile elements of fuel stored therewithin. Preferably, container 2, and separation means 4 are composed of metal or plastic appropriate for storing gasoline 15. Separation means 4, in the form of a plate or sheet, is permanently attached to container 2 along water tight seam 4*a*. The geometric plane of separation means 4 is at an angle, here shown at 5, of greater than zero degrees, and preferably ranging from about 15 to 20 degrees with respect to the floor 2*a* of container 2, and such that the low end 4*b*, that is, the end which is closest to floor 2*a*, is on the opposite side of the high end 14 of the separation means, which is closest to the spout 7. Separation means 4 is provided with opening 6 at its lowest end, whereby opening 6 and spout 7 are on opposite sides of container 2. The size of opening 6 and the height of separation means 4 above floor 2*a* depend on the size of container 2 and the expected depth of contaminants 12. Preferably, for a container 2 having volumetric capacity of about 5 gallons, opening 6 has a size of about 2 square inches and is located at least 1 inch above floor 2*a*, and high end 14 is located about 1.25 inches above floor 2*a*. Separation means 4 effectively segments container 2 into upper section 10 and lower section 11.

Figure 3:
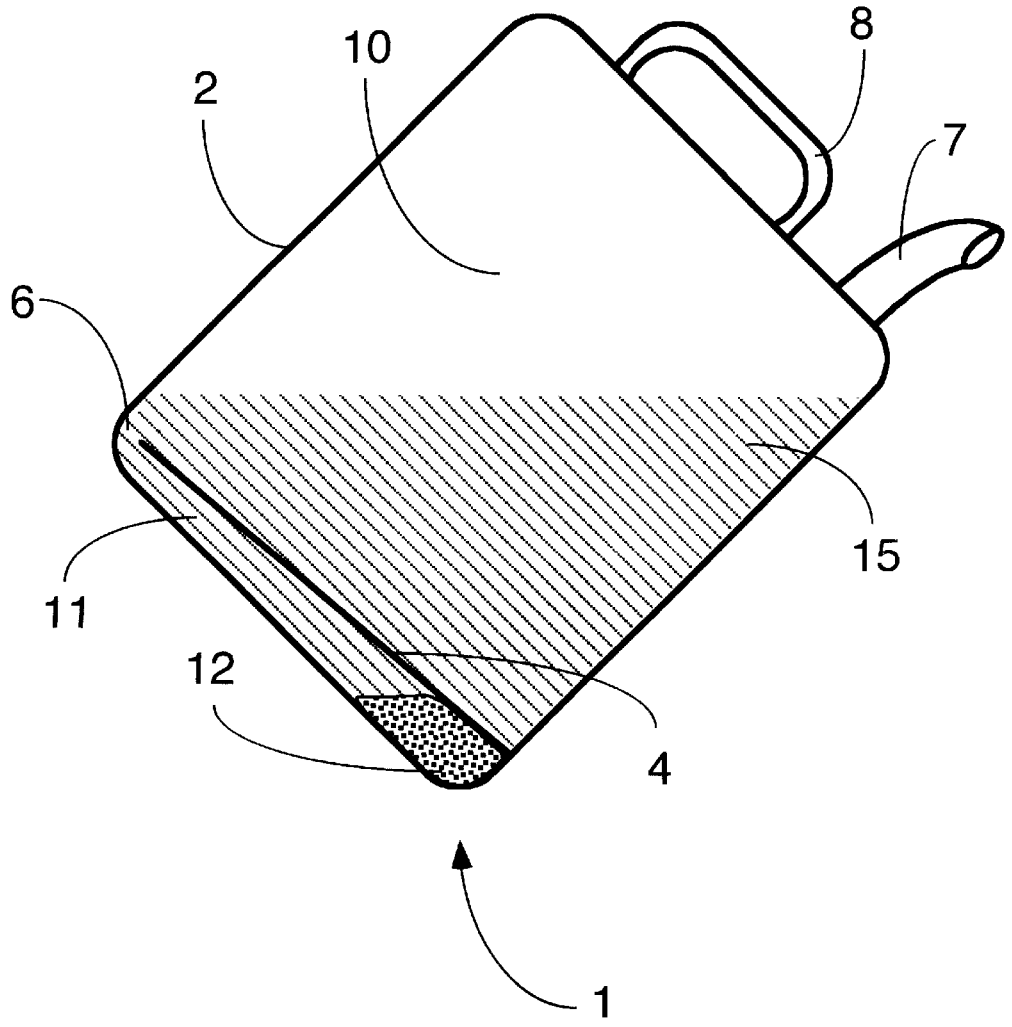
FIG. 3 is a side view of the gasoline container in use.

During storage of gasoline in container 2, water and solid debris, having greater mass density than gasoline and will sink due to gravity. These contaminants 12 will fall downwardly of container 2, collect on the upper surface of the separation means, and be directed down along the surface of the separation means 4 and through opening 6, thus becoming trapped in lower section 11. Even water condensed from humidity will be trapped in this manner. When pouring gasoline for use, as shown in FIG. 3, only gasoline is poured, since the contaminants are trapped in the lower section substantially the entire gasoline content has been removed, the contaminants can be removed by tilting the gasoline storage device 1 away from the spout 7 and allowing the contaminants 12 to reenter section 10 from which they can, in turn, be poured off through spout 7.

Having thus described the invention in rather f all detail, it will be understood that such detail need not be strictly adhered to but that further changes and modifications may suggest themselves to one skilled in the art all falling within the scope of the invention as defined by the subjoined claims.

What is claimed is:

1. A process for separating water and solid debris from gasoline, comprising the steps of:

(a) placing contaminated gasoline into a container having an upper section and a lower section, said upper and lower sections being separated by a plate having, relative to said floor, a high end and a low end said plate having an opening in said low end and forming within said container a plane that makes with the container floor an angle ranging from about 15 to 20 degrees said container having volumetric capacity of about 5 gallons, said opening having a size of about 2 square inches and being located in said low end of said plate at least 1 inch above said floor, and said high end of said plate being located about 1.25 inches above said floor;

(b) separating dense materials comprising water and solid debris in said upper section by allowing the water and solid debris to be pulled by gravity from said gasoline onto the upper surface of said plate and through said hole to said lower section;

(c) displacing gasoline from said lower section to said upper section by accumulation of dense materials in said lower section during said separation step; and (d) preventing reentry of dense materials into said upper section during removal of said gasoline from said container by pouring it from a spout in said upper section.

2. A gasoline container, for separating water and solids from gasoline, comprising:

(a) a gasoline container having a ceiling, side walls and floor, and a spout providing a fuel removing passage therein;

(b) a separation means comprising a plate having, relative to said floor, a high end and a low end and having an opening at said low end, said separation means being tightly joined around its edge within said container and forming therewithin a plane that makes with said floor an angle ranging from about 15 to 20 degrees, said opening being positioned at the end of said plate closest to said floor, and opposite to that closest to said spout, said container having volumetric capacity of about 5 gallons, said opening having a size of about 2 square inches and being located in said low end of said plate at least 1 inch above said floor, said high end of said plate being located about 1.25 inches above said floor and said separation means dividing said container into an upper section in communication with said fuel removing passage and a lower section; and (c) said separation means being operative to (i) separate dense materials comprising water and solid debris in such upper section, such dense materials being caused to fall by gravity through said opening into said lower section, (ii) displace gasoline from said lower section to said upper section by accumulation of dense materials in said lower section during separation, and (iii) prevent reentry of dense materials into said upper section during removal of gasoline through said spout.

3. A gasoline container as recited in claim 2 wherein said gasoline container further comprises a handle, and a vent.

* * * * *